US005975069A

United States Patent [19]

Hamm et al.

[11] Patent Number: 5,975,069

[45] Date of Patent: Nov. 2, 1999

[54] ARCHERY BOW SIGHT APPARATUS

[76] Inventors: Harold M Hamm; Christopher A Hamm, both of 6511 Crestridge Ct.; Brian H. Hamm, Helke Rd., all of Wisconson Rapids, Wis. 54494

[21] Appl. No.: 08/848,668

[22] Filed: Apr. 29, 1997

[51] Int. Cl.[6] ..... F41G 1/467

[52] U.S. Cl. ..... 124/87; 33/265

[58] Field of Search ..... 33/265; 124/87

[56] References Cited

U.S. PATENT DOCUMENTS

| | | | |
|---|---|---|---|
| 3,013,336 | 12/1961 | Pennington | 33/265 |
| 4,541,179 | 9/1985 | Closson | 33/265 |
| 4,570,352 | 2/1986 | Leal | 33/265 |
| 5,092,052 | 3/1992 | Godsey | 33/265 |
| 5,359,780 | 11/1994 | Dallaire | 33/265 |
| 5,465,491 | 11/1995 | Thell | 33/265 |
| 5,651,185 | 7/1997 | Vanderhayden et al. | 33/265 |

*Primary Examiner*—John A. Ricci

[57] ABSTRACT

An archery bow sight apparatus comprising a mounting frame member having a linear slot and an arcuate slot. A linear slide member has first and second guide bushings which are slidably received in the linear slot. A cam bushing located on an articulated cam member is slidably received in a cam slot on the linear slide member. The articulated cam member is pivotally secured to the mounting frame member, and the articulate cam member extends past the arcuate slot. A tensioning member slidably secures the arcuate cam member to the arcuate slot. A sighting member is secured to the linear slide member, and the sighting member includes an elongated sighting aperture having a fiber optic member positioned therein. Indicia is positioned on the mounting frame member, and an indicator extends from the articulated cam member, to provide alignment data responsive to the position of the bow in relation to the distance to the target. The position of the articulated cam member is manually raised or lowered by the user, in response to the location and distance of the user from the target.

20 Claims, 3 Drawing Sheets

ARCHERY BOW SIGHT APPARATUS

BACKGROUND OF THE INVENTION

1. Field of the Invention

This invention relates to an improved archery bow sight apparatus, and more particularly a linearly adjustable archery bow sight having a mounting frame member, a linear slide member, an articulated cam member, and a sighting member.

2. Background of the Invention

Numerous bow sights are known having vertically adjustable bow sights to adjust for the trajectory of the arrow in response to the distance to the target. Some of these devices utilize a trial and error adjustment means, which are adjusted by the user in response to actual field use. Other bow sights utilize scale or distance marks to estimate the distance adjustment required for a given distance to the target. Distance adjustments vary by the bow strength, the draw string length, the target elevation, and the target distance, wind conditions, etc.

U.S. Pat. No. 5,092,052 issuing to Samuel Godsey on Mar. 3, 1992 is representative of the prior art apparatus. This apparatus utilizes a linear track on the mounting plate and a complimentary linear track on the rear edge of the sight plate. A slot is required in the sight plate to compensate for the arcuate movement of the adjustment arm. The linear track is subject to jamming in the presence of particles and debris that become lodged in the track.

U.S. Pat. Nos. 4,109,179, 4,418,479, 4,497,116 and 4,541, 179 utilize a quadrilateral linkage to obtain linear movement of the bow sight.

Other U.S. patents relating to adjustable bow sights include U.S. Pat. Nos. 2,642,661, 2,667,692, 3,318,298, 4,473,959, 4,567,668, 4,977,677 and 4,986,001.

What is needed is an easily adjustable archery bow sight apparatus, which is linearly responsive to adjustment by the user, that maintains the desired adjustment inclination, that is rugged in construction, yet simple in operation, is viewable in a variety of light conditions, is compact in design, light weight, and does not interfere with the operation of the bow or its user during normal hunting or target conditions.

The above mentioned and other features and objects of the invention, and the manner of attaining them will be best understood by reference to the following description of an embodiment of the invention, when considered in conjunction with the accompanying drawings:

DESCRIPTION OF THE PREFERRED EMBODIMENT OF THE INVENTION

Figure 1:
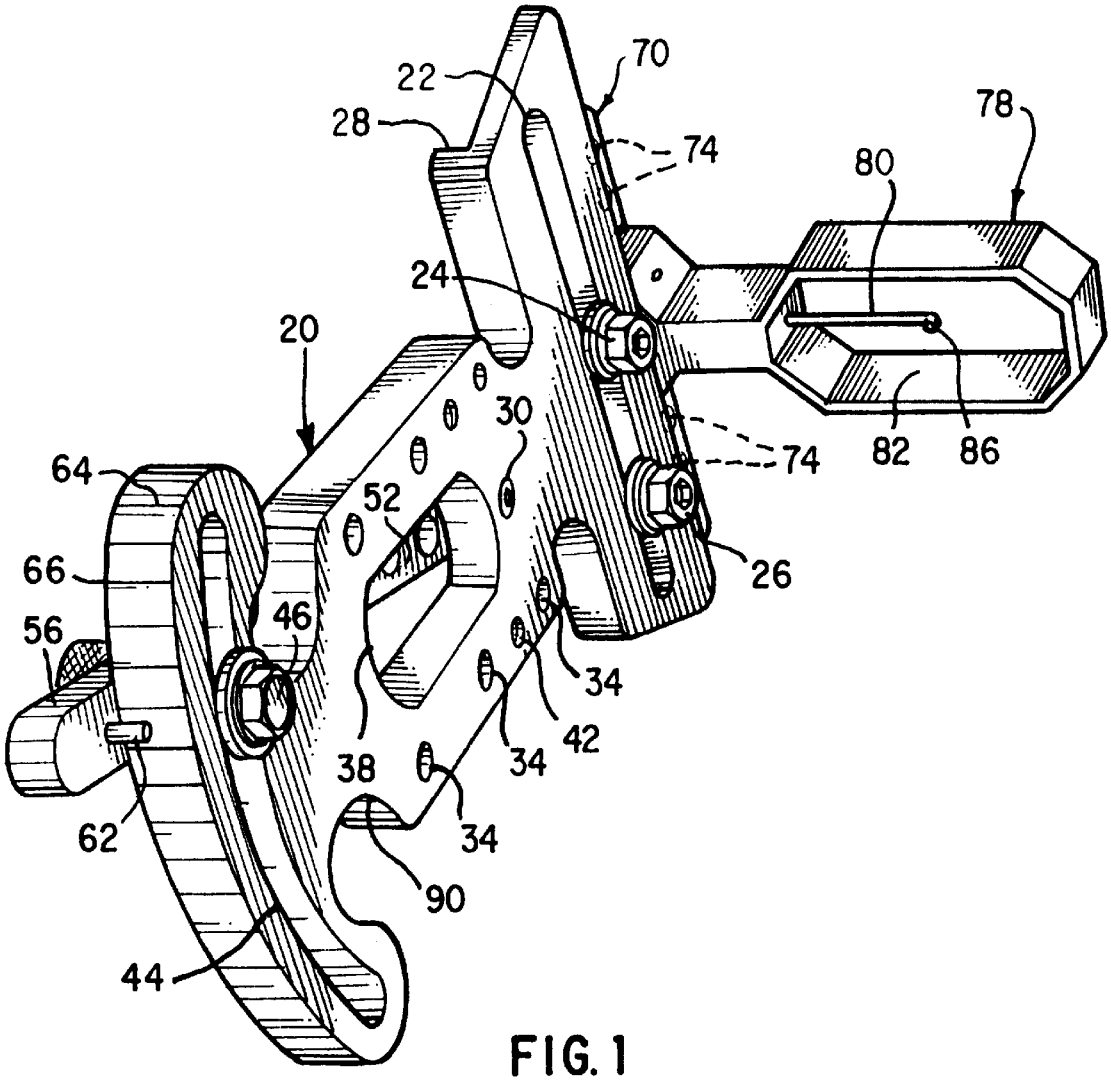
FIG. 1 is a perspective view of the archery bow sight apparatus.

As shown in FIGS. 1 through 6, the archery bow sight apparatus 10 comprises a mounting frame member 20 having a linear slot 22 sized to receive first and second guide bushings 24, 26 therein. The guide bushings 24, 26 are preferably made of a low friction material, such as teflon, or other plastic material. Any low-friction materials known in the art may be used, without departing from the scope of this disclosure, or the accompanying claims.

The mounting frame member 20 preferably includes an offset ledge 28 which extends in spaced relation and in parallel alignment to the linear slot 22. A pivot aperture 30 is centered beneath the linear slot 22, and is sized to receive a pivotal fastening means 32 there-through.

At least one mounting aperture 34 extends through the frame member 20, and is sized to receive a suitable mounting means (not shown), for securing the frame member 20 in proximity to the handle of a bow (not shown).

Figure 2:
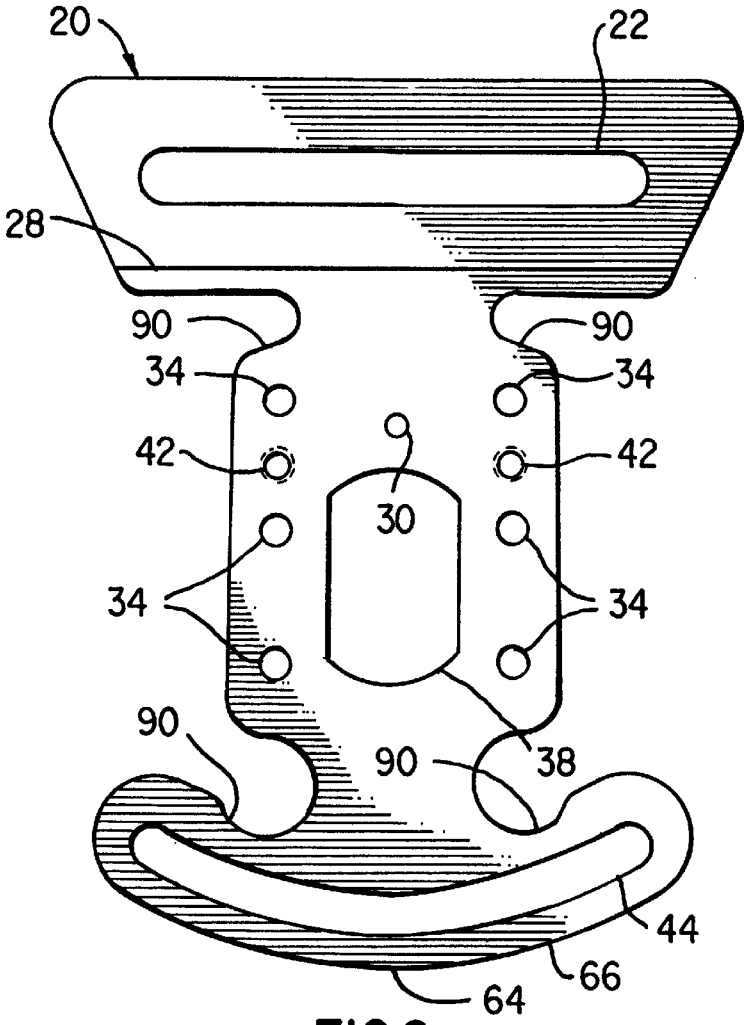
FIG. 2 is a detailed view of the mounting frame member.
Figure 3:
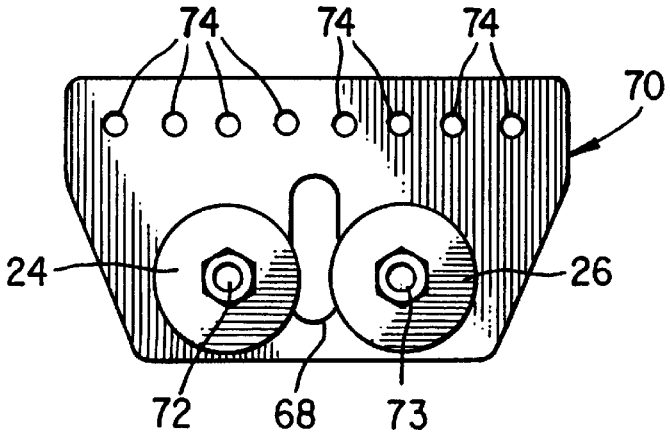
FIG. 3 is a detailed view of the linear slide member.

Preferably, there is a plurality of mounting apertures 34, as shown in FIGS. 1 and 2, with several mounting apertures 34 positioned in spaced relation on opposing sides of a lightening aperture 38 extending through the frame member 20. The plurality of mounting apertures 34 are preferably counter-sunk for flush mounting. The mounting apertures 34 may also be in the form of threaded apertures 42, to suit design or manufacturing preference.

An arcuate slot 44 is located in the frame member 20, as shown in FIG. 1 and FIG. 2. The arcuate slot 44 is sized to receive an arcuate tensioning means 46 there-through.

A pivot aperture 30 is located between the linear slot 22 and the arcuate slot 44. The pivot aperture 30 is sized to closely receive a pivotal fastening means 50 there-through.

Figure 4:
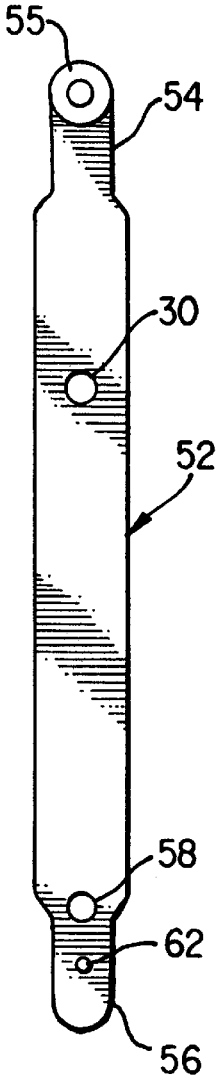
FIG. 4 is a detailed view of the articulated cam member.

An articulated cam member 52 is pivotally secured by a pivotal fastening means 50 to the pivot aperture 30 in the mounting frame member 20. As best shown in FIG. 4, the articulated cam member 52 has a cam end 54 and an opposing arcuate tensioning end 56. The arcuate tensioning end 56 has an tensioning aperture 58 sized to receive an arcuate tensioning means 60 there-through, positioned in alignment with the arcuate slot 44.

Figure 6:
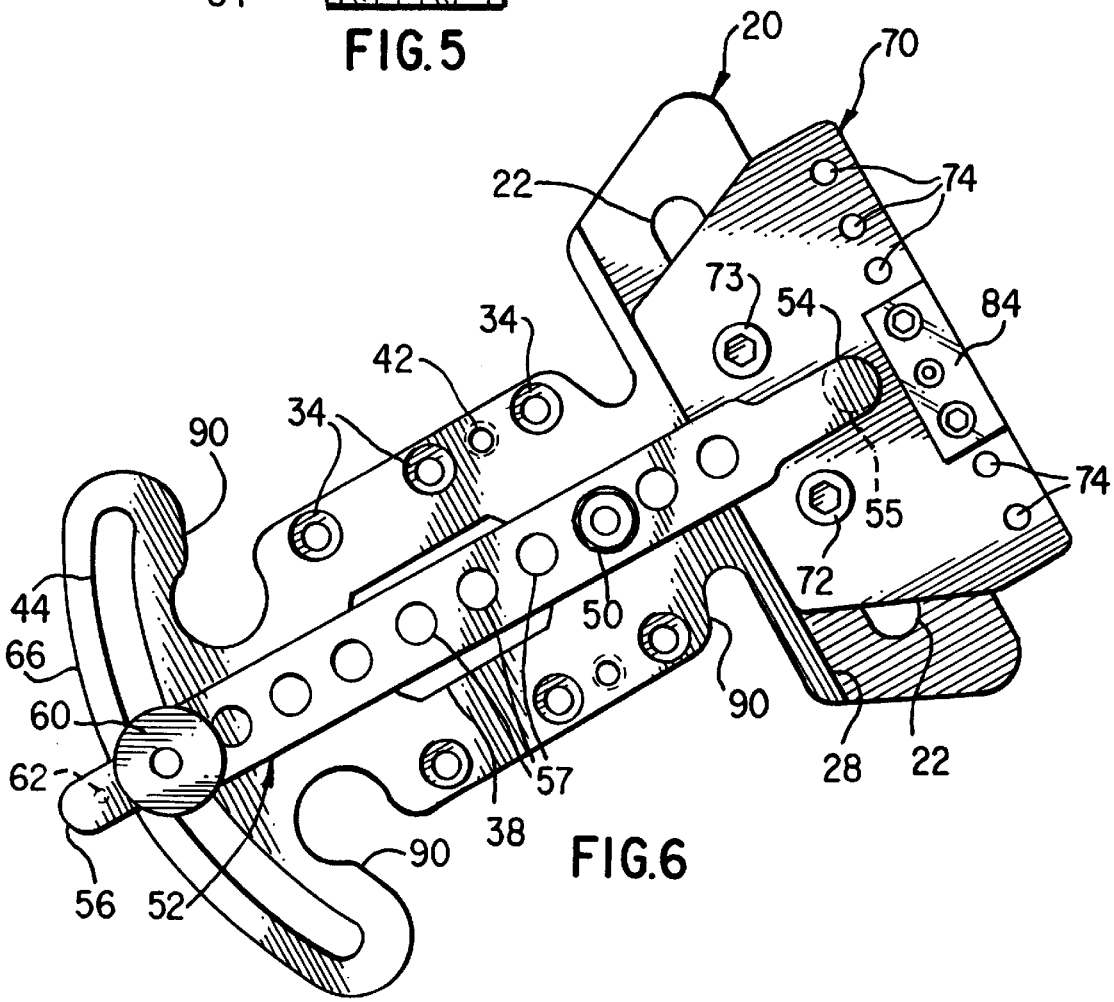
FIG. 6 is an assembly view of the bow sight apparatus, as shown from the opposite side of FIG. 1.

As shown in FIG. 4, the opposing cam end 54 of the articulated cam member 52 is preferably sculpted to provide clearance between the first and second guide bushings 24, 26 as the articulated cam member 52 is moved between the raised and lowered positions. A plurality of lightening holes 57 may be provided in the articulated cam member 52, to reduce weight, and provide an attractive appearance, as shown in FIG. 6.

As best shown in FIG. 1, an indicator means 62 preferably extends from the arcuate tensioning end 56 of the articulated cam member 52. The indicator means 62 is positioned to align with indicia 64 positioned on the arcuate tensioning end 66 of the frame member 20. The indicator means 62 is preferably a pin secured to the arcuate tensioning end 56 of the articulated cam member 52, and positioned in proximity to the arcuate tensioning end 66 of the frame member 20.

The indicia 64 serves as a guide to positioning the articulated cam member 52, to enable the user to repeatably align the archery bow sight apparatus 10 at a desired angle of inclination in relation to the distance to a target (not shown).

A linear slide member 70 has first and second guide apertures 72, 73 which align with the linear slot 22 in the mounting frame member 20, when the linear slide member 70 is slidably positioned adjacent to the offset ledge 28. The first and second guide apertures 72, 73 are secured to the first and second guide bushings 24, 26, so that the linear slide member is adjustably positioned in relation to the mounting frame member 20, as the articulated cam member 52 is manually biased by the user to position the indicator means 62 in relation to the indicia 64.

A cam slot 68 extends between the first and second guide apertures 72, 73 in the linear slide member 70. The cam slot 68 is sized to closely receive a cam bushing 55 mounted to the cam end 54 of the articulated cam member 52. The cam bushing 55 rises and lowers in the cam slot 68, as the articulated cam member is rotated about the pivot aperture 30.

A plurality of sighting member mounting apertures 74 are linearly positioned upon the linear slide member 70 to adjustably position and secure the sighting member 78 to the linear slide member 70 with suitable fastening means 76.

Figure 5:
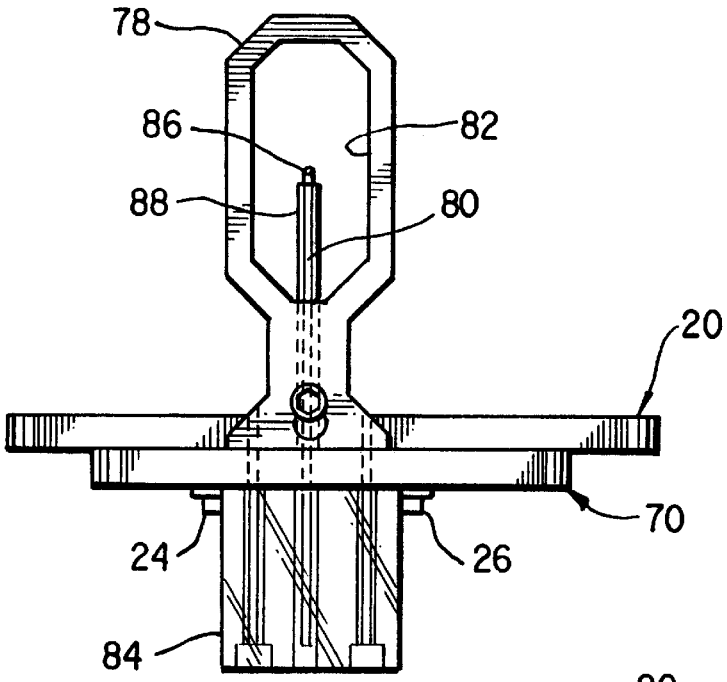
FIG. 5 is a top view of the bow sight apparatus showing the sighting member and light transmissive block installed on the linear slide member, with the fiber optic member positioned within the aperture in the slighting member and in the light transmissive block.

The sighting member fastening means 76 preferably extend through the linear slide member 70 to secure a light transmissive block 78 in alignment with the sighting member 78, on opposite sides of the linear slide member as best shown in FIG. 5.

A fiber optic member 80 extends substantially through the light transmissive block 78, through one of the sighting member mounting apertures 74, and into a viewing aperture 82 located within the sighting member 78. The light indicating end 86 of the fiber optic member 80 is bent to face substantially parallel to the mounting frame member 20 in the general direction of the pivot aperture 30, when the articulated cam member 52 is positioned in proximity to the center of the linear slot 22 in the mounting frame member 20.

The light transmissive block 84 aids in collecting light along the fiber optic member 80, to focus the light at the light indicating end 86 of the fiber optic member 80. Preferably, the fiber optic member 80 is colored to transmit a bright, day-glow type color at the light indicating end 86 of the fiber optic member 80.

A light transmissive sleeve 88 preferably extends about a portion of the fiber optic member, to provide additional rigidity to the fiber optic member 80, while providing additional light gathering capacity.

In operation, the archery bow sight apparatus 10 is mounted a user's bow in proximity to the bow handle (not shown), in a position which will not interfere with the normal operation of the bow during the shooting of a suitable arrow (not shown).

Once mounted, the user moves the arcuate tensioning end 56 of the articulated cam member 52, which pivots about the pivot aperture 30 on the mounting frame member 20 to bias the opposing cam end 54. The cam bushing 55 secured to the cam end 54 rises and lowers within cam slot 68 in the linear slide member 70, as the linear slide member 70 is linearly biased in the linear slot 22 of the mounting frame member 20, which in turn linearly positions the viewing aperture 82 located in the sighting member 78 to bring the light indicating end 86 of the fiber optic member 80 into alignment with a distant target.

If the arrow falls below the target, the arcuate tensioning end 56 of the articulated cam member 52 is raised until the light indicating end 86 of the fiber optic member 80 is aligned with the target. If the arrow shoots above the target, the arcuate tensioning end 56 of the articulated cam member 52 is lowered until the light indicating end 86 of the fiber optic member 80 is aligned with the target. In this way, the archery bow site apparatus 10 enables the user to adjust the bow sight apparatus 10 to the distance to the target, as well as provide for other conditions such as the slope of the ground between the user and the target, wind speed, etc.

The position of the indicator means 62 in relation to the indicia 64 on the arcuate tensioning end 66 of the frame member 20, provides a reliable guide to realigning the bow sight apparatus 10 to the desired setting at a future time. The user may vary the distance to the target at any time, and adjust the bow sight apparatus 10 accordingly, as noted above.

The resistance to movement of the articulated cam member 52 may be adjusted by tightening or loosening the arcuate tensioning means 60, to provide the desired ease of movement, while maintaining the desired position of the light indicating end 86 of the fiber optic member 80 between adjustments.

The mounting frame member 20, the articulated cam member 52, the linear slide member 70, and the sighting member 78 are preferably made of rigid, light weight material, such as aluminum or rigid plastic, or fiberglass materials. Of course other materials may also be used without departing from the scope of this disclosure, or the following claims.

Additional lightening holes may be employed to further lighten the archery bow sight apparatus 10, wherever the rigidity of the archery bow sight apparatus 10 is not unacceptably compromised. The outer profile of the archery bow sight apparatus 10 may also be sculpted 90 as desired to reduce weight, and provide an attractive appearance.

While preferred fastening means are noted in the preferred embodiment disclosed herein, it is well within the scope of one skilled in this are to utilize other known fastening means, such as welding, brazing, soldering, riveting, gluing, etc. and such alternate fastening means are intended to fall within the scope of this disclosure, and the following claims.

Although the present invention has been illustrated and described in connection with certain example embodiments, it will be understood that these are selective and are exemplary of the invention, and are not restrictive thereof. It is reasonably to be expected that those skilled in this art can make numerous revisions and adaptations of the invention, and it is intended that such revisions and adaptations will be construed as being within the limits of the scope of this disclosure and the accompanying claims.

We claim:

1. A linear archery bow sight apparatus, comprising:

a) a frame member having a linear slot near one end, a pivot aperture located in the frame member in spaced relation from the linear slot, an arcuate slot located in the frame member in spaced relation from the pivot aperture, and at least one mounting aperture positioned in the frame member;

b) a linear slide member having a first guide bushing and second guide bushing sized to be slidably received in the linear slot of the frame member, the linear slide member further having a cam slot located between the first and second guide bushings;

c) an articulated cam member pivotally secured to the pivot aperture of the frame member; the articulated cam member having a cam end with a cam bushing secured thereto, the cam bushing sized to be slidably received in the cam slot located in the linear slide member, the articulated cam member further having a tensioning end with a tensioning member positioned to be slidably received in the arcuate slot in the frame member;

d) and a sighting member is adjustably secured to the linear slide member, the sighting member having a viewing aperture positioned thereon; and wherein the articulated cam member is manually biased about the pivot aperture, to slidably position the linear slide member to selectively raise and lower the sighting member, in relation to a the mounting frame member of the archery bow sight apparatus.

2. The linear bow sight apparatus of claim 1, wherein a fiber optic member extends into the viewing aperture of the sighting member, to improve sighting in low light conditions.

3. The linear bow sight apparatus of claim 2, wherein a light transmissive block is secured to the linear slide member, and the fiber optic member extends through the light transmissive block into the viewing aperture of the sighting member.

4. The linear bow sight apparatus of claim 2, wherein the end of the fiber optic member positioned within the viewing aperture of the sighting member is bent substantially parallel with the frame member, and positioned to face in the general direction of the pivot aperture when the articulated cam member is centered in the linear slot.

5. The linear bow sight apparatus of claim 2, wherein a light transmissive sleeve is secured about a portion of the fiber optic member extending into the viewing aperture to aid in stiffening the fiber optic member and to serve as an additional light gathering source.

6. The linear bow sight apparatus of claim 2, wherein the fiber optic member is colored to transmit a bright, day-glow color at the light indicating end of the fiber optic member.

7. The linear bow sight apparatus of claim 1, wherein an offset ledge is provided in the frame member in alignment with the linear slot to slidably receive the linear slide member, and to compactly position the articulated cam member in relation to the linear slide member.

8. The linear bow sight apparatus of claim 1, wherein the first and second guide bushings secured to the linear slide member comprise a low friction slidable bearing means received within the linear slot of the frame member.

9. The linear bow sight apparatus of claim 1, wherein the mounting frame member includes a lightening aperture positioned between the pivot aperture and the arcuate slot.

10. The linear bow sight apparatus of claim 1, wherein a plurality of mounting apertures are positioned in the mounting frame member between the linear slot and the arcuate slot.

11. The linear bow sight apparatus of claim 1, wherein an indicator means extends from the arcuate tensioning end of the articulated cam member, and indicia is positioned on the arcuate tensioning end of the articulated cam member.

12. The linear bow sight apparatus of claim 1, wherein a plurality of sighting member mounting apertures are linearly positioned upon the linear slide member to adjustably secure the sighting member in relation to the linear slide member.

13. The linear bow sight apparatus of claim 1, wherein the mounting frame member, the articulated cam member, the linear slide member and the sighting member are made of a rigid, light weight material.

14. The linear bow sight apparatus of claim 1, wherein the outer profile of the mounting frame member is sculpted to reduce weight and to provide an attractive appearance.

15. A linear archery bow sight apparatus, comprising:

a) a frame member having a linear slot near one end of the frame member, a pivot aperture located in spaced relation from the linear slot, an offset ledge in the frame member in alignment with the linear slot and positioned between the linear slot and the pivot aperture, an arcuate slot located in spaced relation from the pivot aperture, and at least one mounting aperture positioned in the frame member;

b) a linear slide member having a first guide bushing and a second guide bushing, the first and second guide bushings sized to be slidably received in the linear slot of the frame member, the linear slide member further having a cam slot located between the first and second guide bushings, and a plurality of sighting member mounting apertures linearly positioned through the linear slide member;

c) an articulated cam member pivotally secured to the pivot aperture of the frame member; the articulated cam member having a cam end with a cam bushing secured thereto, the cam bushing sized to be slidably received in the cam slot located in the linear slide member, the articulated cam member further having a tensioning end with a tensioning member positioned to be slidably received in the arcuate slot in the frame member;

d) a sighting member secured to the sighting member mounting apertures in the linear slide member, the sighting member having a viewing aperture therein; and e) a fiber optic member secured to the sighting member, the fiber optic member extending within the viewing aperture to provide a target indicator in low light conditions, wherein the articulated cam member is manually biased about the pivot aperture, to slidably position the linear slide member in relation to the mounting frame member, to provide an adjustable linear archery bow sight apparatus.

16. The linear bow sight apparatus of claim 15, wherein the mounting frame member includes a lightening aperture positioned between the pivot aperture and the arcuate slot, and a plurality of mounting apertures are positioned in the mounting frame member on opposing sides of the lightening aperture.

17. The linear bow sight apparatus of claim 15, wherein a light transmissive block is secured to the linear slide member, and the fiber optic member extends within the light transmissive block to provide additional light gathering capacity to the fiber optic member.

18. The linear bow sight apparatus of claim 15 wherein a light indicating end of the fiber optic member is bent substantially parallel to the mounting frame member, to face in the general direction of the pivot aperture, when the cam member is centered in the linear slot, and wherein the fiber optic member is colored to transmit a bright, day-glow color at the light indicating end of the fiber optic member.

19. A linear archery bow sight apparatus, comprising:

a) a frame member having a linear slot near one end of the frame member, a pivot aperture located in spaced relation from the linear slot, an offset ledge in the frame member in alignment with the linear slot, an arcuate slot located in spaced relation from the pivot aperture, at least one mounting aperture positioned in the frame member, the frame member further having indicia positioned in proximity to the arcuate slot on the frame member;

b) an articulated cam member pivotally secured to the pivot aperture of the frame member; the articulated cam member having a cam end with a cam bushing secured thereto, the articulated cam member having a tensioning end with a tensioning member positioned to be slidably received in the arcuate slot in the frame member, the articulated cam member further having an indicator on the arcuate tensioning end of the articulated cam member, in alignment with indicia positioned on the arcuate tensioning end of the frame member, to repeatably align the archery bow sight apparatus at a desired angle of inclination;

c) a linear slide member having a first and second guide bushings sized to be slidably received in the linear slot of the frame member, a plurality of sighting member mounting apertures in the linear slide member, the linear slide member having a cam slot disposed between the first and second guide bushings, the cam slot sized to closely receive the cam bushing located on the articulated cam member;

d) a sighting member adjustably secured to at least one of the plurality of sighting member mounting apertures, the sighting member having a viewing aperture disposed therein, e) a fiber optic member secured to the sighting member, the fiber optic member extending within the viewing aperture;

f) a light transmissive sleeve positioned about a portion of the fiber optic member extending within the viewing aperture;

g) a light transmissive block secured to the linear slide member, the fiber optic member extending within the light transmissive block to provide additional light gathering capacity to the fiber optic member, and wherein an end of the fiber optic member extending within the viewing aperture is bent substantially parallel to the mounting frame member, and positioned to face in the general direction of the pivot aperture when the articulated cam member is centered about the linear slot in the mounting frame member;

wherein the articulated cam member is manually biased about the pivot aperture in the frame member, to slidably position the linear slide member in relation to frame member, to adjustably position the viewing aperture in relation to the mounting frame member to provide an adjustable linear archery bow sight apparatus.

20. The linear bow sight apparatus of claim 19, wherein the fiber optic member is colored to transmit a bright, day-glow color at the light indicating end of the fiber optic member.

* * * * *